US008915346B2

(12) United States Patent
Petermann et al.

(10) Patent No.: US 8,915,346 B2
(45) Date of Patent: Dec. 23, 2014

(54) DEVICE FOR HANDLING NOTES OF VALUE, COMPRISING TWO INTERMEDIATE STORAGE UNITS FOR THE INTERMEDIATE STORAGE OF NOTES OF VALUE

(75) Inventors: Udo Petermann, Altenbeken (DE); Paul Freitag, Steinheim (DE); Richard Duesterhus, Paderborn (DE); Hendrik Hoeschen, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/985,842

(22) PCT Filed: Feb. 17, 2012

(86) PCT No.: PCT/EP2012/052760

§ 371 (c)(1),
(2), (4) Date: Sep. 17, 2013

(87) PCT Pub. No.: WO2012/110629

PCT Pub. Date: Aug. 23, 2012

(65) Prior Publication Data

US 2014/0001104 A1 Jan. 2, 2014

(30) Foreign Application Priority Data

Feb. 17, 2011 (DE) ..... 10 2011 000 797

(51) Int. Cl.
*G07F 7/04* (2006.01)
*G07F 19/00* (2006.01)
*G07D 11/00* (2006.01)

(52) U.S. Cl.
CPC ..... *G07D 11/0084* (2013.01); *G07F 19/202* (2013.01); *G07D 11/0003* (2013.01); *G07D 11/006* (2013.01)
USPC ..... 194/206

(58) Field of Classification Search
CPC ..... G07D 11/0003; G07D 11/0006; G07D 11/0021; G07D 11/0033; G07D 11/0034
USPC ..... 194/206, 207; 209/534; 235/379
See application file for complete search history.

(56) References Cited

U.S. PATENT DOCUMENTS 789,707 A 5/1905 Bellamy
4,365,700 A * 12/1982 Arimoto et al. ..... 194/206

(Continued)

FOREIGN PATENT DOCUMENTS

DE 3830339 A1 3/1989
DE 197 36 453 A1 2/1999

(Continued)

OTHER PUBLICATIONS

English Translation of the Written Opinion of the ISA for PCT/EP2012/052760, mailed Jul. 24, 2012; ISA/EP, (8 pages).

(Continued)

*Primary Examiner* — Mark Beauchaine
(74) *Attorney, Agent, or Firm* — Harness, Dickey & Pierce, P.L.C.

(57) ABSTRACT

The invention relates to a device (10) for handling notes of value, comprising a sensor unit (300) for detection of at least one feature of each note of value, and a control unit (28) which classifies the notes of value into accepted notes of value and sheet-shaped media to be returned, dependent on the feature to be detected by the sensor unit (300). A sorting gate (400) is arranged downstream the sensor unit (300), wherein the control unit (28) controls the sorting gate (400) to supply notes of value classified as accepted notes of value to a first intermediate storage (32), and notes of value classified as sheet-shaped media to be returned to a second intermediate storage (500).

16 Claims, 7 Drawing Sheets

(56) References Cited

U.S. PATENT DOCUMENTS

| | | | | |
|---|---|---|---|---|
| 4,822,018 | A | 4/1989 | Hain | |
| 4,889,220 | A | 12/1989 | Yoshinori et al. | |
| 5,836,577 | A * | 11/1998 | Arikawa et al. | 270/58.04 |
| 7,954,816 | B2 | 6/2011 | Freitag et al. | |
| 8,340,391 | B2 | 12/2012 | Petermann | |
| 2009/0272795 | A1 | 11/2009 | Stapfer et al. | |
| 2010/0117296 | A1 | 5/2010 | Freitag et al. | |
| 2010/0198396 | A1 | 8/2010 | Brexel et al. | |
| 2010/0213023 | A1 | 8/2010 | Freitag et al. | |
| 2012/0211935 | A1 | 8/2012 | Petermann et al. | |
| 2013/0099439 | A1 | 4/2013 | Duesterhus | |

FOREIGN PATENT DOCUMENTS

| | | | |
|---|---|---|---|
| DE | 10203175 | C1 | 6/2003 |
| DE | 10203176 | A1 | 8/2003 |
| DE | 10-2006-028633 | A1 | 12/2007 |
| DE | 10-2006-058549 | A1 | 6/2008 |
| DE | 10-2008-009054 | A1 | 8/2009 |
| DE | 10-2008-039357 | A1 | 2/2010 |
| DE | 10-2008-056711 | A1 | 5/2010 |
| DE | 10-2009-006810 | A1 | 8/2010 |
| EP | 1 220 166 | A1 | 7/2002 |
| EP | 2101301 | A1 | 9/2009 |
| GB | 1485041 | A | 9/1977 |
| GB | 2166898 | A | 5/1986 |
| WO | WO-99-28223 | A1 | 6/1999 |

OTHER PUBLICATIONS

International Preliminary Report on Patentability for PCT/EP2012/052760 mailed Aug. 29, 2013 with English translation (19 pages).

* cited by examiner

DEVICE FOR HANDLING NOTES OF VALUE, COMPRISING TWO INTERMEDIATE STORAGE UNITS FOR THE INTERMEDIATE STORAGE OF NOTES OF VALUE

CROSS-REFERENCE TO RELATED APPLICATIONS

This application is a National Stage of International Application No. PCT/EP2012/052760, filed Feb. 17, 2012, and published in German as WO 2012/110629 A1 on Aug. 23, 2012. This application claims the benefit and priority of German Application No. 10 2011 000 797.0, filed Feb. 17, 2011. The entire disclosures of the above applications are incorporated herein by reference.

BACKGROUND

This section provides background information related to the present disclosure which is not necessarily prior art.

TECHNICAL FIELD

The invention relates to a device for handling sheet-shaped media, which comprises a transport unit for transporting the sheet-shaped media, and a sensor unit for detection of at least one feature of a respective sheet-shaped medium. A control unit classifies the sheet-shaped media into accepted sheet-shaped media and sheet-shaped media to be returned, dependent on the feature detected by the sensor unit.

DISCUSSION

The device for handling notes of value is, in particular, an automatic cash safe, an automatic cash system and/or an automated teller machine, such as a deposit machine for depositing banknotes and checks. In particular, the sheet-shaped media to be input into the device can be supplied as one stack. The sheet-shaped media input are classified into accepted sheet-shaped media and sheet-shaped media to be returned, wherein accepted sheet-shaped media are those sheet-shaped media which are to be held in the device, and sheet-shaped media to be returned are those sheet-shaped media which are not be held in the device. The accepted sheet-shaped media are in particular notes of value of at least one preset currency and/or checks. The sheet-shaped media to be returned, on the other hand, are banknotes of a currency different from the preset currency, damaged banknotes, damaged checks, and/or other sheet-shaped media, such as business cards.

In known devices, all sheet-shaped media input as one stack by the user are intermediately stored in an intermediate storage. If only one sheet-shaped medium to be returned is present among the intermediately stored sheet-shaped media, all the sheet-shaped media intermediately stored in the intermediate storage are returned to the user who subsequently must remove the sheet-shaped media not accepted and must then input a new stack containing only the accepted sheet-shaped media. This leads to less comfort for the user, since on the one hand he/she must input a stack multiple times, and on the other hand he/she must sort the accepted sheet-shaped media himself/herself.

SUMMARY OF THE INVENTION

It is an object of the invention to specify a device for handling sheet-shaped media which allows for input of sheet-shaped media with high ease of use for a user.

According to the invention, a sorting gate which is connected with the sensor unit is arranged downstream the sensor unit. The control unit controls the sorting to supply a sheet-shaped medium classified as accepted sheet-shaped medium to a first intermediate storage for intermediate storage of sheet-shaped media classified as accepted sheet-shaped media, and to supply a sheet-shaped medium classified as sheet-shaped medium to be returned to a second intermediate storage for intermediate storage of sheet-shaped media classified as sheet-shaped media to be returned. It is achieved this way, that the sheet-shaped media of the input stack are intermediately stored corresponding to their classification, separated into accepted sheet-shaped media and sheet-shaped media to be returned. Thus, it is not necessary to return all the sheet-shaped media input, but only those sheet-shaped media must be returned to the user that are stored in the second intermediate storage. The other sheet-shaped media, classified as accepted sheet-shaped media and stored in the first intermediate storage, on the contrary, can remain in the device and be processed.

The device for handling sheet-shaped media is in particular an automatic cash safe, an automatic cash system and/or an automated teller machine, such as a deposit machine for depositing banknotes and checks. In particular, the device is designed such that both banknotes and checks can be input, wherein the banknotes and checks can be input together, mixed in one single stack.

The sensor unit in particular comprises at least one image detection unit, in particular at least one CCD line past which the sheet-shaped medium are transported separately. The image detection unit captures at least one image comprising a representation of each supplied sheet-shaped medium. By means of an image processing algorithm stored therein, the control unit determines dependent on this image the at least one feature of the sheet-shaped medium and classifies the sheet-shaped medium dependent thereon. The features determined are in particular the presence of magnetic information, the presence of water marks, the dimensions of the sheet-shaped medium, and/or features characteristic of certain types of notes of value.

In particular, banknotes of a preset currency and checks are classified as accepted sheet-shaped media. Damaged banknotes, banknotes of a currency different from the one preset, damaged checks, and all other sheet-shaped media, on the contrary, are classified as sheet-shaped media to be returned.

In particular, the sorting gate is connected via a second transport path with the first intermediate storage, and via a third transport path with the second intermediate storage. The control unit controls the sorting gate to direct a sheet-shaped medium classified as an accepted sheet-shaped medium from the first into the second transport path, and to direct a sheet-shaped medium classified as sheet-shaped medium to be returned from the first into the third transport path.

What is meant by directing a sheet-shaped medium from one transport path into the other in this connection is in particular that the sorting gate is set in a sorting gate position in which it guides the sheet-shaped medium from the one transport path into the other. A change of the direction of the note of value must not stringently occur herein, i.e. the two transport paths between which the sorting gate guides the sheet-shaped medium may be orientated in the same direction, in particular may be arranged in one plane. Preferably, the center axes of the two transport paths are lying on a straight line.

Preferably, the third transport path is designed to be shorter than the second transport path, so that the sheet-shaped media to be returned must be transported a shorter way through the device than the accepted sheet-shaped media. As the sheet-shaped media to be returned are, among others, damaged banknotes and checks as well as other sheet-shaped media, the condition and dimensions of which are unknown, such a third transport path which is as short as possible reduces the possibility that the sheet-shaped media to be returned catch with transport elements or components of the device, which would lead to jamming and/or interruptions. The length of the second transport path is in particular between 10 times and 100 times, preferable between 50 times and 80 times the length of the third transport path.

In a particularly preferred embodiment of the invention, the second intermediate storage is arranged directly following the sorting gate so that the third transport path is designed to be minimal, whereby the possibility of interruptions due to the sheet-shaped media to be returned is minimized, too. What is meant by arrangement directly following the sorting gate in particular is that no other units of the device are arranged between the sorting gate and the second intermediate storage. In this embodiment, the third transport path in particular has a length of 0 mm, so that the sorting gate directs the sheet-shaped medium directly into the second intermediate storage, with the transition point between sorting gate and intermediate storage being regarded as transport path in this case.

The sorting gate itself is preferably arranged directly following the sensor unit so that the sheet-shaped media to be returned are rejected via the sorting gate by transport into the second intermediate storage directly after classification of the sheet-shaped media. Thus, the number of sheet-shaped media to be further processed is minimized from the start.

The second intermediate storage preferable comprises at least one pair of belts with two running belts guided across a plurality of transport elements. The sheet-shaped media to be returned which are to be intermediately stored in the second intermediate storage are held in the second intermediate storage between the two belts and are transported together with the belts in a running direction in which the running belts are driven by a drive unit. The transport elements are in particular rollers or drums across which the belts are guided. These rollers or drums, respectively, are driven via a central drive unit of the device so that the belts, too, are driven via the contact between the rollers or drums, respectively, and the belts. A correspondingly designed intermediate storage allows for storage of as many sheet-shaped media to be returned as possible in confined space so that small space only is required for the second intermediate storage.

In an alternative embodiment of the invention, the second intermediate storage may have only one running belt guided across transport elements, and a plurality of rollers, wherein the sheet-shaped media classified as sheet-shaped media to be returned that are stored in the second intermediate storage are received between the belts and the rollers and are transported together with the belts in running direction. In this embodiment, the belt is in particular driven via a drive unit, wherein the rollers preferably are designed as non-driven pressure rollers. The second intermediate storage preferably comprises at least one stopping element extending into the running transport path along which the sheet-shaped media intermediately stored in the intermediate storage are transported, by means of which element overlapping notes of value are stopped and are pushed one on top of the other to form a stack.

The sheet-shaped media are in particular held in the second intermediate storage such that two sheet-shaped media consecutively received in running direction overlap each other at least partly. What is achieved thereby is that a greater number of sheet-shaped media can be received since due to overlapping a greater number of sheet-shaped media can be received consecutively with a given belt length.

In a particularly preferred embodiment of the invention, the sheet-shaped media intermediately stored in the second intermediate storage are held therein as a stack, so that on the one hand, the number of sheet-shaped media that can be held in the second intermediate storage with a short belt length is as large as possible, and on the other hand the sheet-shaped media to be returned that are intermediately stored in the second intermediate storage can be returned to the user as a stack. Therefore, it is not necessary to provide a stacking unit for stacking the sheet-shaped media to be returned, thus achieving a simple, space-saving and cost-efficient structure.

The distance between the two belts of the belt pair or between the belt and the rollers, respectively, is preferably defined such that the stack consisting of the sheet-shaped media received in the second intermediate storage can preferably hold between four and six sheet-shaped media at most. This guarantees that the maximum number of sheet-shaped to be returned that is typically contained in the stack input by the user can be received in the second intermediate storage, and that the second intermediate storage still has a compact structure.

In an alternative embodiment of the invention, less than three or more than ten sheet-shaped media at most may be received in the second intermediate storage at the same time. Further, the second intermediate storage can alternatively be designed such that the sheet-shaped media to be intermediately stored therein are received consecutively and do not overlap. In particular, the sheet-shaped media received consecutively have a preset minimum mutual distance so that they do not interfere with each other during transport in running direction, and that the occurrence of jamming is avoided.

Further, the second intermediate storage is preferably designed such that the sorting gate supplies the sheet-shaped media classified as sheet-shaped media to be returned to the second intermediate storage at a first position, and that a further sorting gate removes the sheet-shaped media held in the second intermediate storage from the second intermediate storage at a second position different from the first position. In this way, it is achieved that supply and removal of the sheet-shaped media are spatially separated so that supply and removal can occur in parallel and the transport paths via which the sheet-shaped media are supplied and the sheet-shaped media to be returned are output can be separate from each other.

The further sorting gate is in particular shiftable between a sorting-gate removal position and a sorting-gate intermediate-storage position. In the sorting-gate removal position, a sorting gate element of the further sorting gate reaches into the running transport path along which the sheet-shaped media intermediately stored in the intermediate storage are transported and directs the intermediately stored sheet-shaped media out of the second intermediate storage. In the sorting-gate intermediate-storage position, on the contrary, the sorting gate element is arranged outside the running transport path so that transport of the intermediately stored notes of value in running direction is not inhibited by the sorting gate element. The sorting gate element is in particular pivotable about an axis of rotation an is pivoted about this axis of rotation by means of a drive unit, for example a solenoid, between the sorting-gate removal position and the sorting-gate intermediate-storage position.

Further, the device preferably comprises an output unit for output of the sheet-shaped media stored in the second intermediate storage and removed therefrom to the person using the device. Herein, the sheet-shaped media are in particular returned as a stack. If the sheet-shaped media to be returned are already held as stack in the second intermediate storage, this stack is removed from the second intermediate storage and supplied to the output unit by means of transport elements, such that the stack is output to the user. If, however, the sheet-shaped media classified as sheet-shaped media to be returned are held in the second intermediate storage separately or only partly overlapping each other, they are supplied to a stacking unit after removal from the second intermediate storage by means of which they are stacked to a stack which is then output via the output unit.

Furthermore, it is advantageous if the device comprises an input unit for input of a stack of sheet-shaped media and a separating unit for separating the sheet-shaped media of the stack input. The transport unit transports the separated sheet-shaped media to the sensor unit which then detects at least one feature of the sheet-shaped media, as described above, so that the control unit can classify the sheet-shaped media accordingly and control the sorting gate accordingly. The input unit and the output unit are in particular designed in an integrated way as one input and output unit so that input and output of the stacks can be effected via one unit and a simple structure is achieved.

Further, the device comprises in particular a display unit which displays at least one information about the sheet-shaped media intermediately stored in the first intermediate storage to the person using the device, after all sheet-shaped media have been received in the first intermediate storage or the second intermediate storage, respectively. This information in particular comprises information on the number of sheet-shaped media intermediately stored in the first intermediate storage and/or information on the sum of the values of these sheet-shaped media. Further, the user is asked via the display unit to input a confirmation information via an input unit of the device. When no confirmation information is input via the input unit by the user within a preset time interval or when the user makes a negative input then the notes of value intermediately stored in the second intermediate storage as well as the notes of value intermediately stored in the first intermediate storage are returned to the user via the output unit.

For this purpose, the device comprises in particular a stacking unit for stacking the sheet-shaped media intermediately stored in the first intermediate storage to a first stack, and a stack combining unit which combines this first stack with the second stack formed by the sheet-shaped media intermediately stored in the second intermediate storage to form a single combined stack. Thus, only one single stack is returned to the user, containing the sheet-shaped media intermediately stored in both the first and the second intermediate storage.

If the user, however, inputs the confirmation information the accepted sheet-shaped media intermediately stored in the first intermediate storage are supplied to a safe of the device via a transfer slot, and are further transported to value note cassettes or value note stacking devices provided in the safe in which they are deposited. The sheet-shaped media classified as sheet-shaped media to be returned and intermediately stored in the second intermediate storage, on the contrary, are returned to the user via the output unit.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
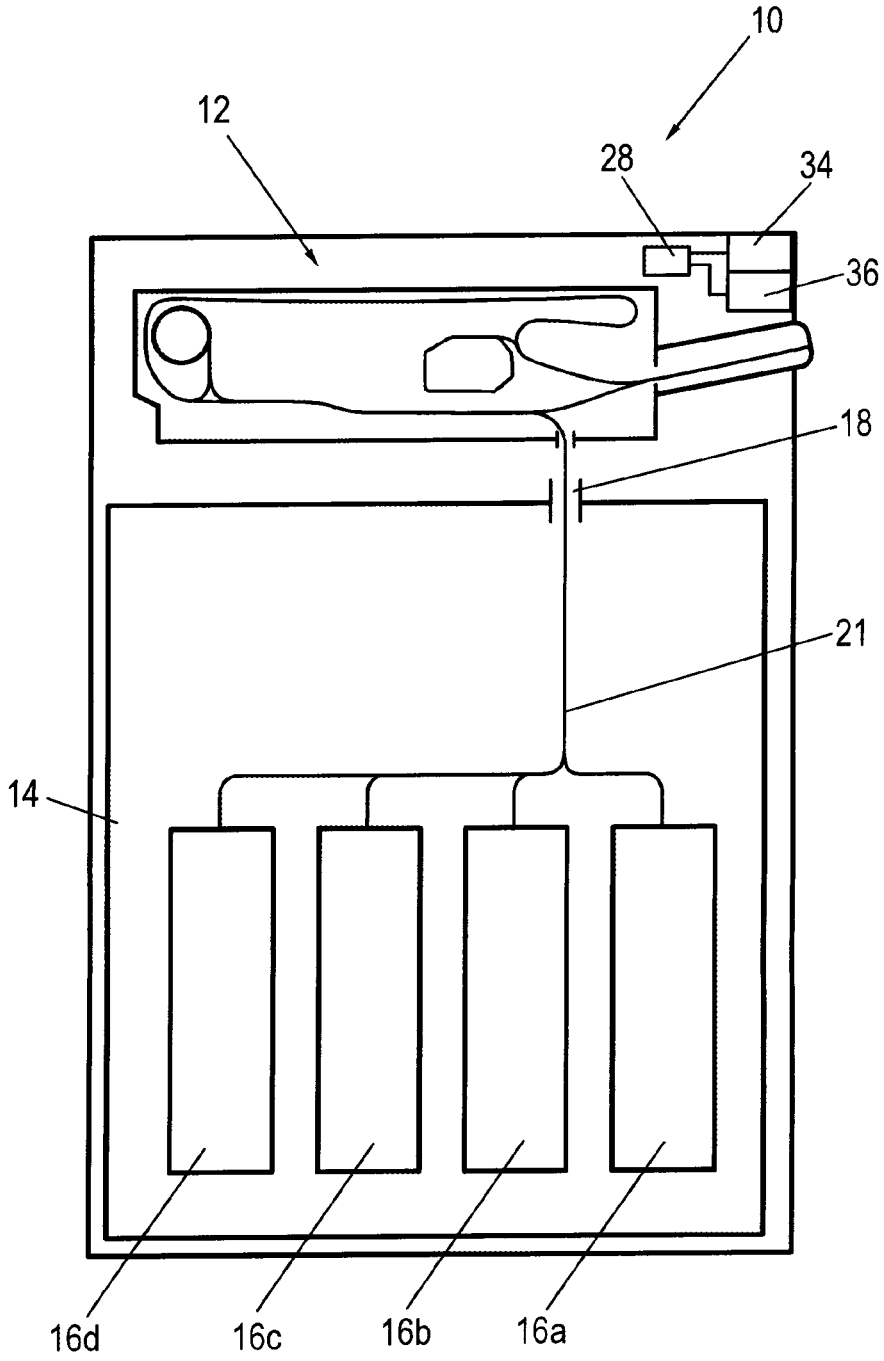
FIG. 1 shows a schematic illustration of a device for handling notes of value.

In FIG. 1, a schematic illustration of a device 10 for handling notes of value is illustrated. The device 10 is in particular an automatic cash safe, an automatic cash system and/or an automated teller machine, such as a deposit machine for depositing banknotes and checks.

The device 10 comprises a head module 12 and a safe 14. The structure of the head module 12 is described in more detail in connection with FIG. 2. In the safe 14, four value note cassettes 16*a* to 16*d* are arranged in which the notes of value can be held. Here, in particular one of the value note cassettes 16*a* to 16*d* is provided for holding checks and the other three value note cassettes 16*a* to 16*d* are provided for holding banknotes. The banknotes are in particular held in a type-specific manner, i.e. in one value note cassette 16*a* to 16*d* always only banknotes of one denomination are contained. Alternatively, also mixed storage may be realized, i.e. that in one value note cassette 16*a* to 16*d* notes of value of different denominations are held in a mixed manner. In an alternative embodiment, also more than four or less than four, in particular two value note cassettes 16*a* to 16*d* can be provided in the safe 14. In particular, a so-called reject cassette can be provided in which notes of value are held that are suspected of being counterfeit and/or are damaged. In a preferred embodiment, two value note cassettes 16*a* to 16*d*, namely one for holding checks and one for holding banknotes are provided.

Here, the notes of value can be held in the value note cassettes 16*a* to 16*d* in stacked form in a receiving area as well as wound up between two film tapes onto a roller store. Different types of value note cassettes can also be used within the safe 14.

In the present embodiment, the device 10 can be designed as a mere depositing device into which notes of value can only be deposited. Alternatively, it can also be designed as a recycling device into which notes of value can be deposited and can again be withdrawn therefrom.

The safe 14 has a transfer slot 18 through which the notes of value are supplied from the head module 12 to the safe 14.

From the transfer slot 18, the notes of value are transported via a transport unit identified with the reference sign 21 to the value note cassettes 16*a* to 16*d*.

Figure 2:
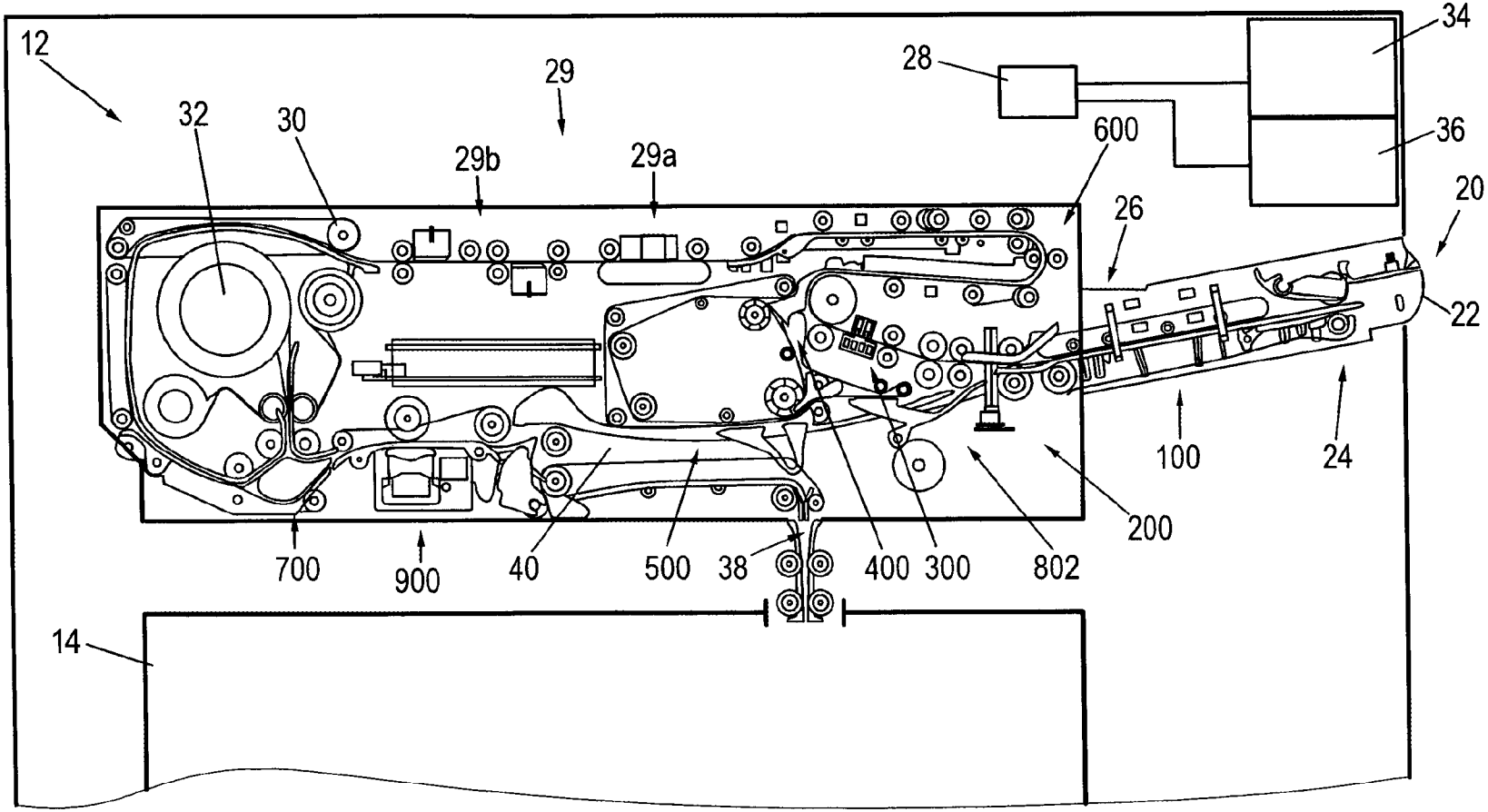
FIG. 2 shows a schematic illustration of a head module of the device according to FIG. 1.

In FIG. 2, a schematic illustration of the head module 12 according to FIG. 1 is shown. The head module 12 has an input and output unit 20 via which the notes of value can be input in the form of a value note stack. Further, via this input and output unit 20 individual notes of value and/or value note stacks can be returned to the user of the device 10. The input and output unit 20 in particular has a so-called shutter 22 by means of which an opening for feeding and outputting the notes of value can be opened and closed.

A value note stack input via the input and output unit 20 is transported to a first aligning unit 100 by means of a transport unit 24. By means of the first aligning unit 100, the notes of value of the value note stack are placed into a preset orientation or at least the orientation of a part of the notes of value of the value note stack is changed such that it is approximated to the preset orientation. By means of a transport unit 26, the aligned value note stack is supplied to a separating unit 200 which separates the notes of value of the value note stack and supplies the separated notes of value to a first sensor unit 300.

The first sensor unit 300 comprises an image detection unit by means of which at least one image with a representation of this note of value is taken of each supplied note of value. Dependent on the representation of the note of value in the image, a control unit 28 of the device 10 determines at least one feature of the note of value and, dependent on this feature, classifies the note of value into checks, banknotes of a preset currency and other sheet-shaped media. The other sheet-shaped media can, for example, be notes of value of a currency different from the preset one and/or other sheet-shaped media which were erroneously input by the user of the device. For example, these can be business cards or account statements. The preset currency is in particular the currency that is to be handled by means of the device 10, in particular that is to be held in the value note cassettes 16*a* to 16*d*.

Those notes of value that were neither classified as checks nor as banknotes of the preset currency will be transported via a sorting gate 400 into a second intermediate storage 500 for intermediate storage of sheet-shaped media and will be intermediately stored therein, preferably as a second value note stack. The checks and the banknotes of the preset currency, on the other hand, are supplied via the sorting gate 400 to a second aligning unit 600. By means of this second aligning unit 600 the checks are aligned in a first preset target orientation and the banknotes are aligned in a second target orientation differing from the first target orientation. In particular, several different target orientations for banknotes of different denominations are preset and the second aligning unit 600 aligns the notes of value in different preset target orientations not only dependent on whether checks or banknotes are concerned but additionally also dependent on the denomination of the banknotes.

The aligned notes of value are then supplied to a second sensor unit 29 by means of which the authenticity of the banknotes is determined and by means of which magnetic information on the checks is read out. The sensor unit 29 comprises a banknote sensor unit 29*a* by means of which the authenticity of the banknotes is verified and a check sensor unit 29*b* by means of which the authenticity of the checks is verified and information printed on the checks is read out. The first sensor unit 300 and the second sensor unit 29 form together with the control unit 28 in particular a non-counterfeit money and check detection module. In the determination of the authenticity of the banknotes and/or checks preferably also information determined by means of the sensor unit 300 is taken into account.

Subsequently, the notes of value are transported toward a second sorting gate 700 by means of further transport elements, one of which is exemplarily identified with the reference sign 30. Via the second sorting gate 700, all notes of value of the previously input value note stack which were classified as checks or banknotes of the preset currency, are at first supplied to a first intermediate storage 32 and intermediately stored therein. The intermediate storage 32 is in particular designed in the form of a roller store in which the notes of value to be held are held in a wound up manner between two film tapes. After all notes of value of the input value note stack have been accommodated in the first intermediate storage 32 or the second intermediate storage 500, at least one information about the notes of value held in the first intermediate storage 32 and/or in the second intermediate storage 500 is output to the user via a display unit 34. This information in particular comprises information about the number of input notes of value and/or the value of the sum of the denominations of the input notes of value that are held in the first intermediate storage 32. Further, the user is in particular asked to input a confirmation information via an input unit 36.

When no confirmation information is input via the input unit 36 by the user within a preset time interval after request and/or when the user makes a negative input then the notes of value contained in the first intermediate storage 32 are transported away from this intermediate storage and are supplied to a stacking unit 40, by means of which a first value note stack is formed from all notes of value contained in the first intermediate storage 32. Further, the second value note stack contained in the second intermediate storage 500 is removed from the second intermediate storage 500. Both the first value note stack and the second value note stack are supplied to a stack combining unit 802 by means of which a single combined value note stack is formed from the first and the second value note stacks. This combined value note stack is then returned to the user via the input and output unit 20.

When, on the other hand, the user inputs the confirmation information within the preset time interval after the respective request, then the second value note stack is removed from the second intermediate storage 500 and is returned to a user via the input and output unit 20.

The notes of value intermediately stored in the first intermediate storage 32, on the other hand, are supplied along a transport path 38 to the safe 14 and are received in the value note cassettes 16*a* to 16*d*. Before they are transported into the safe 40, the checks intermediately stored in the first intermediate storage 32 are cancelled in that a cancellation print image is printed onto a preset print area of the check. For this purpose, a printing unit 900 for imprinting the checks is provided between the second sorting gate 700 and the transport path 38. Via the sorting gate 700, the checks are supplied to the printing unit 900 such that the printing area on which the cancellation information is to be printed faces the print head of the printing unit 900 so that the print head can print the cancellation print image onto this printing area.

By means of the afore-described head module 12, it is achieved that in one device 10 checks and banknotes can be handled together and these can be supplied to the device in an arbitrarily mixed manner in one stack. In this way, a particularly high operating comfort is achieved for a user of the device 10 as the user does not have to manually presort the notes of value into checks and banknotes nor does he have to preset which type of notes of value is supplied, as is the case in known devices.

Figure 3:
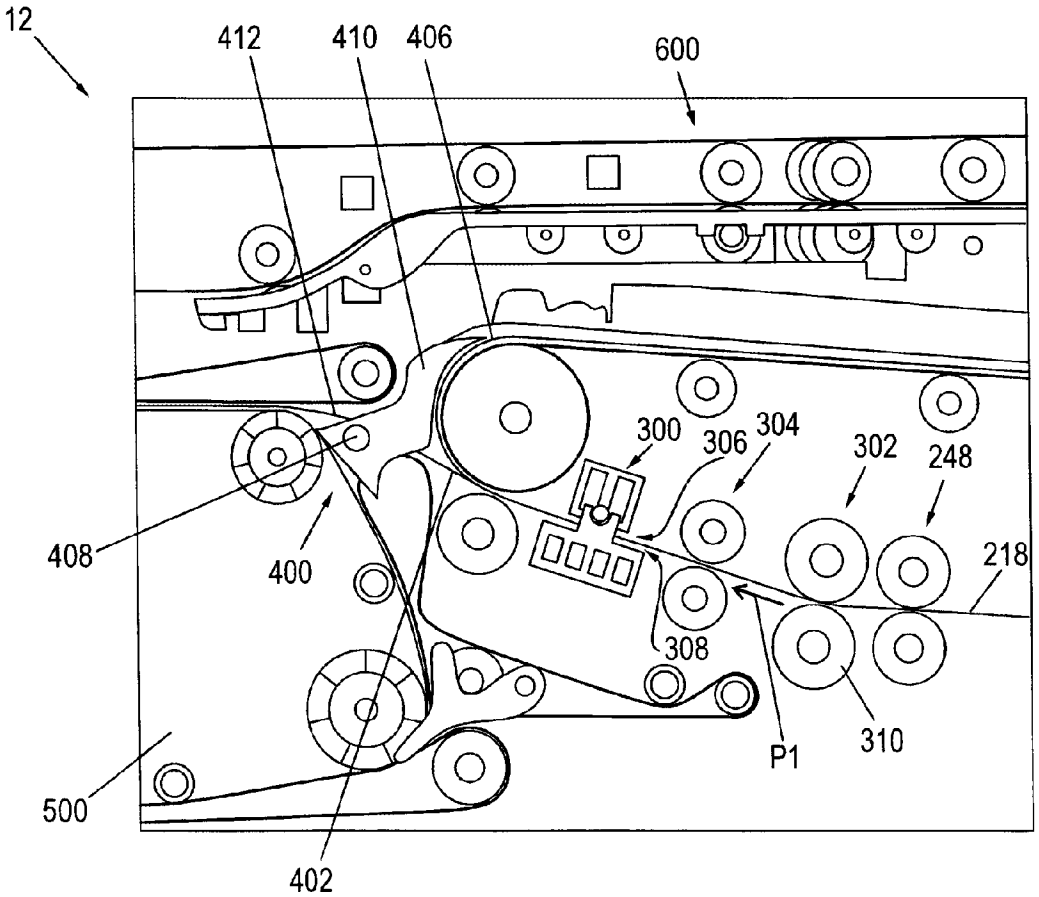
FIG. 3 shows a schematic illustration of a detail of the head module according to FIG. 2.

In FIG. 3, a schematic view of a detail of the head module 12 according to FIG. 2 is illustrated, wherein in particular the sensor unit 300 is shown. After the notes of value of the value note stack mentioned have been separated by means of the separating unit 200, the separated notes of value are transported separately along a transport path 218 by means of transport elements 248, 302, 304 and are supplied to the sensor unit 300 arranged downstream of the separation unit 200. The transport elements 248, 302, 304 are in particular designed as a plurality of roller pairs, each pair comprising two rollers which are arranged on opposite sides of the transport path 218, one of them being exemplarily designated by reference sign 310. Between the rollers 310 of a roller pair, a gap is formed through which the note of value is transported. At least one roller 310 of each roller pair, preferably both rollers 310 of each roller pair, are drivable by means of a driving unit, in particular a central driving unit of the device 10, such that the driven roller 310 transports the note of value located in the gap via the contact with said note of value in transport direction P1, thus supplying it to the sensor unit 300.

The sensor unit 300 comprises an image detection unit 306 arranged on a first side of the transport path 218, and an illumination unit 308 arranged on a second side of the transport path 218 opposite to the first side. A note of value located between the illumination unit 308 and the image detection unit 306 is backlit, and thus also light is transmitted through it. At least one image comprising a representation of the note of value is captured by means of the image detection unit 306. In a preferred embodiment of the invention, a plurality of images, in particular an image sequence is taken from each note of value supplied to the sensor unit 300.

In the present embodiment, the image detection unit comprises at least one line of image detection elements aligned in a direction transverse to the transport direction of the notes of value and extending at least across the width of the note of value to be detected having the greatest width. Preferably, the image detection unit 306 comprises a plurality of lines of image detection elements arranged one after the other in transport direction, each of them detecting an image of the note of value transported past the image detection unit 306.

In an alternative embodiment of the invention, a plurality of image detection units can be provided wherein the image detection units are preferably arranged such that images comprising representations of both sides of the note of value can be captured by means of them. In another alternative embodiment of the invention, the illumination unit 308 may be arranged on the same side as the image detection unit 306, such that the note of value is illuminated via reflection light.

For better readability, the method by means of which the control unit 28 classifies the notes of value dependent on the image captured by means of the image detection unit 306 or dependent on the images captured by the image detection unit 306, respectively, into different notes of value is explained in the following for capturing one image of the note of value to be classified. The explanations are, by analogy, applicable to capturing a plurality of images of the note of value, wherein a more accurate classification is possible when a plurality of images is taken.

The image detection unit 306 captures the image of the note of value during transport of the note of value past it in transport direction P1. Thus, there is no need for stopping the banknote such that fast processing of the notes of value is possible. In an alternative embodiment of the invention, the note of value may be stopped temporarily when it is located between the image detection unit 306 and the illumination unit 308. When the note of value is stopped, the image is captured by means of the image detection unit 306 before the note of value is further transported in transport direction P1.

The control unit 28 determines in a first step at least one dimension of the note from the representation of the note of value comprised in the image. For this purpose, an image processing algorithm is stored in the control unit 28 that is executed by the control unit 28 for determining said dimension. The control unit 28 preferably determines not only one dimension of the note of value but both, length and width of the note of value. Here, length is in particular to be understood as the lengths of the longer edges of the note of value whereas width is the length of the shorter edges of the note of value. The note of value is transported in particular in a short-side-first manner, i.e. with one of the shorter edges first through the head module 12.

Further, the dimensions of checks and banknotes to be processed by means of the device 10 are preset in the control unit 28. By comparing the determined dimensions of the note of value with said preset dimensions, the control unit 28 determines in the first step whether, considering the dimensions, the note of value is supposed to be a banknote or a check.

If it is determined in the first step that the note of value cannot be a banknote or a check, this note of value is classified as sheet-shaped medium to be returned.

Additionally, the control unit 28 is capable of detecting damages of the banknote, such as tears, folds, holes, and the like, in the image by means of at least one further preset image processing algorithm, and of classifying the notes of value into damaged and undamaged notes of value depending thereon. The damaged notes of value are likewise classified as sheet-shaped medium to be returned, regardless of whether banknotes, checks or other sheet-shaped media are concerned.

If, however, it was determined the first step that the note of value could be an undamaged banknote or an undamaged check due to its dimension, presence of at least one preset characteristic feature of banknotes is verified in a second step. For this purpose, so-called currency data sets are stored in the control unit 28 that contain various characteristic features of different banknotes to be processed by means of the device 10, in particular of different currencies and different denominations of banknotes of the different currencies. The control unit 28 verifies whether said preset features are detectable in the image, and dependent on this comparison it determines whether the banknote is an accepted banknote. Accepted banknotes are those banknotes which belong to the set of currency to be processed by the device 10. In particular, specific security features of the banknotes may be used as characteristic features. Further, for example the presence of marks, logos, water marks, and/or other security features can be detected.

In case it is determined in the second step that the note of value is not an accepted banknote it is verified in a third step whether the note of value is a check. For this purpose, characteristic features of checks to be processed are stored in the control unit 28, too, and the control unit 28 verifies whether the preset feature or the preset features, respectively, are present in the image by comparing the image with said preset features. If the comparison results in that the sheet-shaped medium is not a check the sheet-shaped medium is classified as sheet-shaped medium to be returned.

Further, the control unit 28 may determine other features, such as the orientation and/or position of the note of value depending on the representation of the note of value comprised in the image and may additionally consider these determined features when controlling the aligning unit 600.

A characteristic feature of checks verified is in particular the presence of magnetic information in a preset area of the supposed check. Typical checks have a so-called MICR code line comprising a single-line magnetic imprint with a preset character height of 2.8 mm to 3.2 mm located in an area the rest of which is free of magnetism, the so-called clear band. Detection of this magnetic information on the note of value to be monitored is effected in particular via illuminating the note of value with light within the infrared spectral range and evaluating the reflection and/or absorption properties of the note of value in the area in which the MICR code line should be present. The reflection and/or absorption property of the magnetic imprint clearly differs from that of the clear band such that the presence of the magnetic imprint can be reliably determined in an easy manner.

Additionally or alternatively, a light-dark distribution in the image may be determined and compared with a preset light-dark distribution of checks. In this manner, it is in particular possible to detect an optic code line of checks.

Furthermore, specific gray distributions, preset marks, preset logos, or preset water marks may be stored as characteristic features. By means of preset image processing algorithms, it is checked by the control unit whether at least one or a plurality of said preset characteristic features is present in the image. Dependent on the result of this comparison, the control unit 28 determines whether the note of value is a check.

In particular, a plurality of images may be captured for determining the presence of the characteristic preset features, wherein different spectral ranges are captured when capturing different features and the image of the note of value is evaluated in said different spectral ranges. Thus, in particular such characteristic features of notes of value may be considered, too, which are visible only in a certain spectral range.

The above-described order of the three steps is interchangeable. In particular, after having determined that the notes of value could be a check or a banknote on the basis of the dimensions, it would be possible to first determine whether the notes of value are a check via the check-specific characteristic features. If it was determined that it is not a check, it is determined via comparison with the banknote-specific characteristic features whether an accepted banknote is concerned.

In a particularly preferred embodiment of the invention, steps 1 through 3 may be carried out simultaneously so that an especially quick classification of the notes of the value into the individual note of value types is effected. Thus, fast processing of the notes of value is achievable.

Further, the sensor unit 300 may use further sensors in addition to the image detection unit 306 or instead of the image detection unit 306 for classification of the notes of value supplied thereto into accepted banknotes, checks and sheet-shaped media to be returned.

The sheet-shaped media classified as banknotes and the sheet-shaped media classified as checks form together the accepted sheet-shaped media.

The control unit 28 controls the sorting gate 400 to supply a sheet-shaped medium classified as banknote or as check, i.e. classified as accepted sheet-shaped medium to the aligning unit 600. For this purpose, the sorting gate 400 is connected with the sensor unit 300 via a first transport path 402, and with the aligning unit 600 via a second transport path 406. The sorting gate 400 comprises a sorting gate element 410 pivotable about an axis of rotation 408 that directs, in a first sorting-gate position, a note of value supplied along the first transport path 402 from the sensor unit 300 into the second transport path 406.

The sensor unit 300 is in particular useful for a kind of pre-verification of the notes of value. Verification of the authenticity of the notes of value is carried out in particular by means of the sensor unit 29, where preferably information or features determined by the sensor unit 300 are taken into account, too.

The aligning unit 600 places the checks in a first preset target orientation and the accepted banknotes in a second preset target orientation different from the first target orientation. These target orientations are preset such that both the accepted banknotes and the checks can be processed by the sensor unit 29, and such that jamming of notes of value does not occur during further transport within the device. Subsequently, all sheet-shaped media classified as accepted banknotes or checks are transported to the first intermediate storage 32, as already described above in connection with FIGS. 1 and 2, and are intermediately stored therein until all the sheet-shaped media input as a stack have been intermediately stored either in said first intermediate storage 32 or in the second intermediate storage 500.

If, however, a sheet-shaped medium was classified by the control unit 28 as a sheet-shaped medium to be returned the control unit 28 controls the sorting gate 400 to transport the sheet-shaped media supplied thereto via the first transport path 402 into a third transport path 412 which connects the sorting gate 400 with the second intermediate storage 500. For this purpose, the sorting gate element 410 is pivoted about the axis 408 into the second sorting-gate position. Altering the sorting-gate position of the sorting gate 400 is in particular carried out by means of a solenoid.

Figure 4:
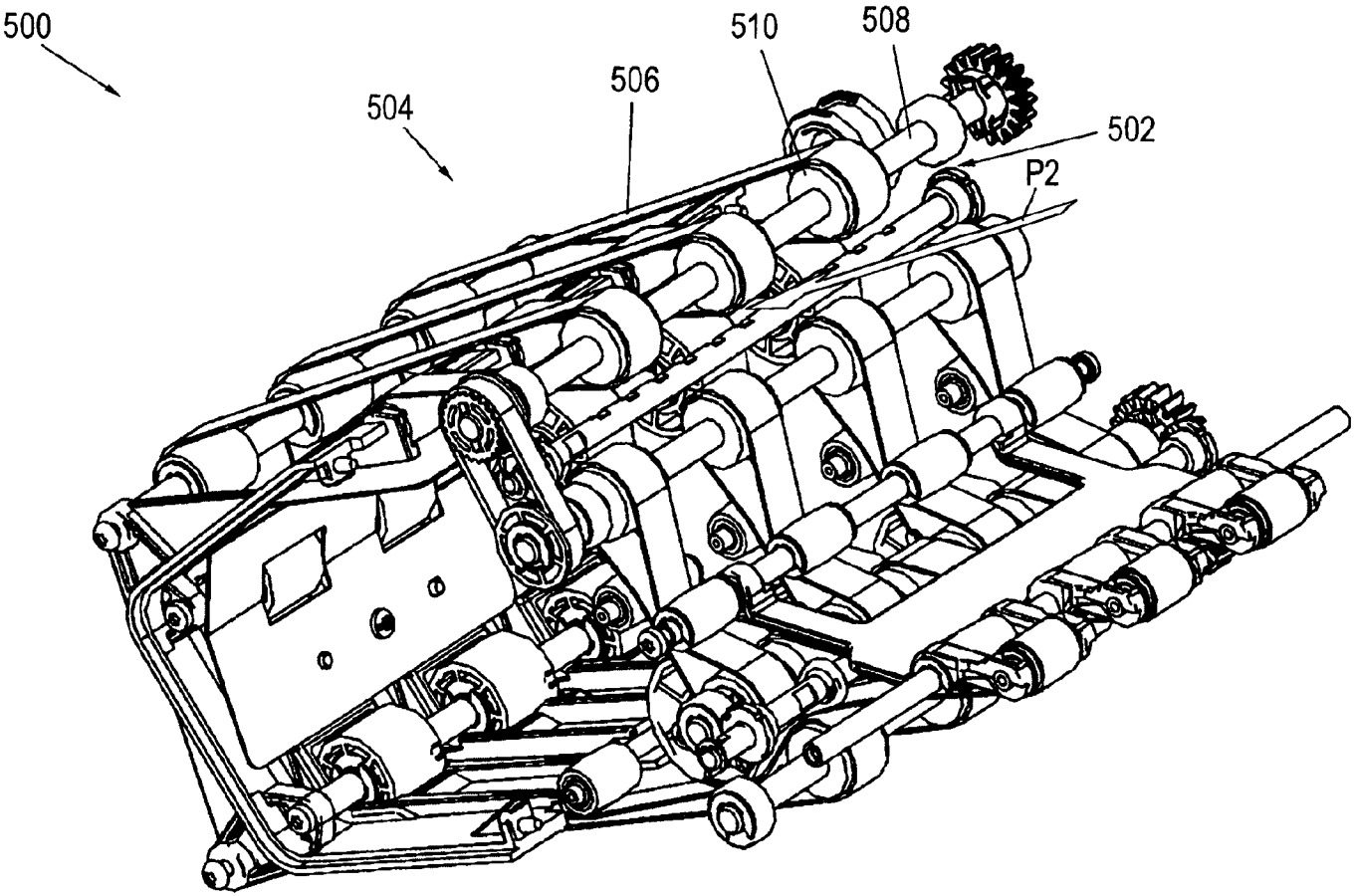
FIG. 4 shows a schematic perspective illustration of an intermediate storage of the head module according to FIGS. 2 and 3.
Figure 5:
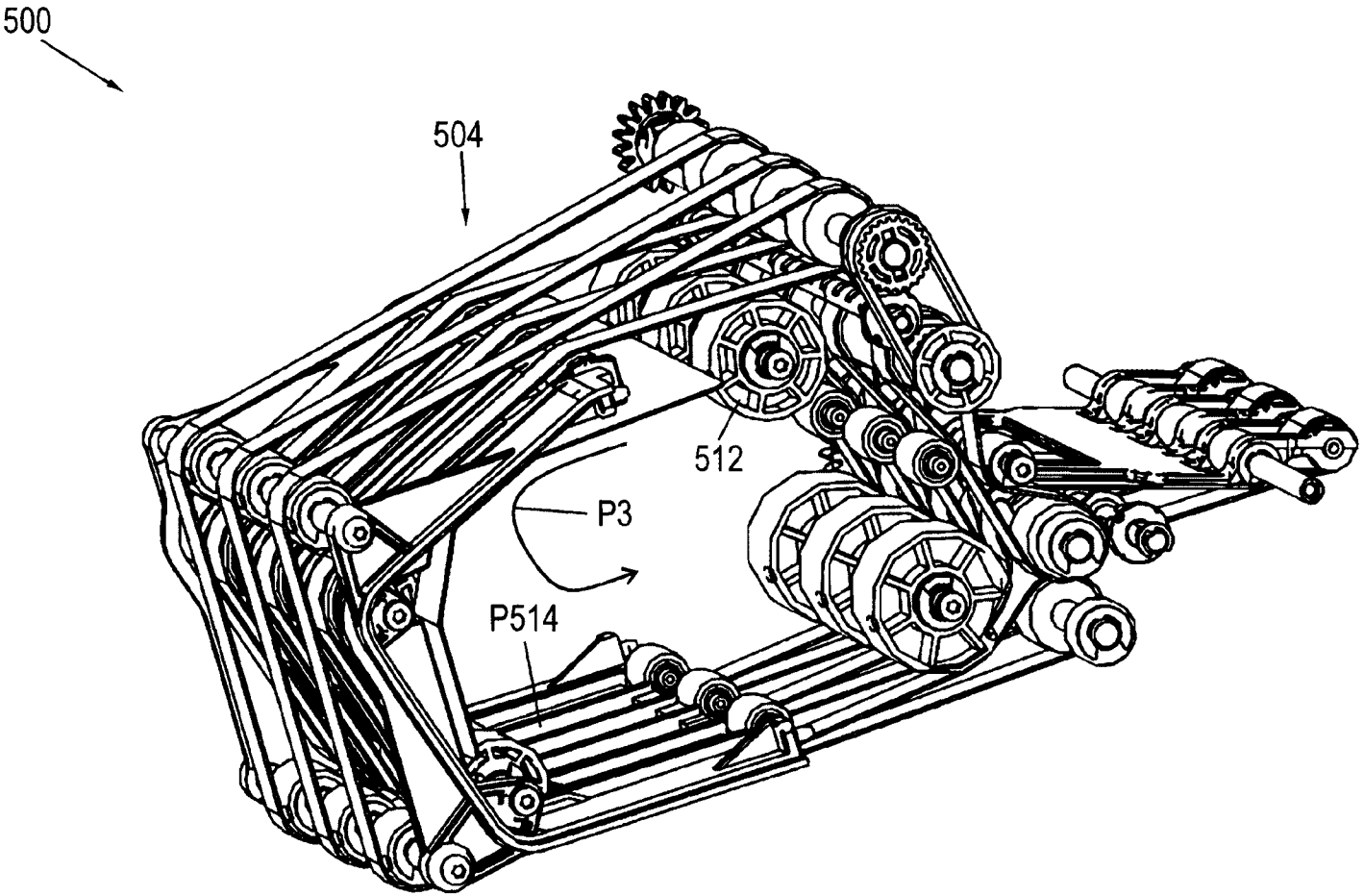
FIG. 5 shows a further schematic perspective illustration of the intermediate storage according to FIG. 4.

FIGS. 4 and 5 each show a schematic perspective illustration of the second intermediate storage 500. The sheet-shaped media arriving from the sorting gate 400 are supplied to the intermediate storage 500 via a transfer gap 502 in direction of the arrow P2. The sheet-shaped media are then transported by a transport unit 504 in a running direction P3 within the second intermediate storage 500. The transport unit 504 comprises a plurality of belts one of which is exemplarily identified with the reference sign 506. The belts 506 are guided across rollers 510 supported on shafts 508. The shafts 508 are drivable via a central driving unit of the device 10 that is not shown, so that the rollers 510 rotatably connected thereto, and thus the belts 506 are driven such that they transport the sheet-shaped media received in the intermediate storage 500 in running direction P3. Further the transport unit 504 comprises a plurality of non-driven pressure rollers 512 and guiding elements 514 which together with the belts 506 define the transport path along which the sheet-shaped media are transported in running direction P3. Herein, the sheet-shape media are received between the belts 506 as well as the pressure rollers 512 and the guiding element 514.

The sheet-shaped media intermediately stored in the second intermediate storage 500 are in particular stored in the second intermediate storage in form of a stack. For this purpose, supply of the sheet-shaped media and transport of the sheet-shaped media in running direction P3 are coordinated such that a sheet-shaped medium newly supplied via the transfer gap 502 lies on top of the stack formed by the sheet-shaped media previously received in the intermediate storage 500. In particular, supply is synchronized such that the edge of the sheet-shaped medium to be supplied which is the front edge in supply direction P2 is approximately flush with the edge of the stack which is the front edge in running direction P3, so that the sheet-shaped medium supplied rests on the stack already held, with either its front or back side.

In an alternative embodiment of the invention, the sheet-shaped media can be received such that they overlap only partly. Further, it is alternatively possible that the sheet-shaped media are consecutively received in the intermediate storage 500, and in particular have a preset minimum mutual distance.

Figure 6:
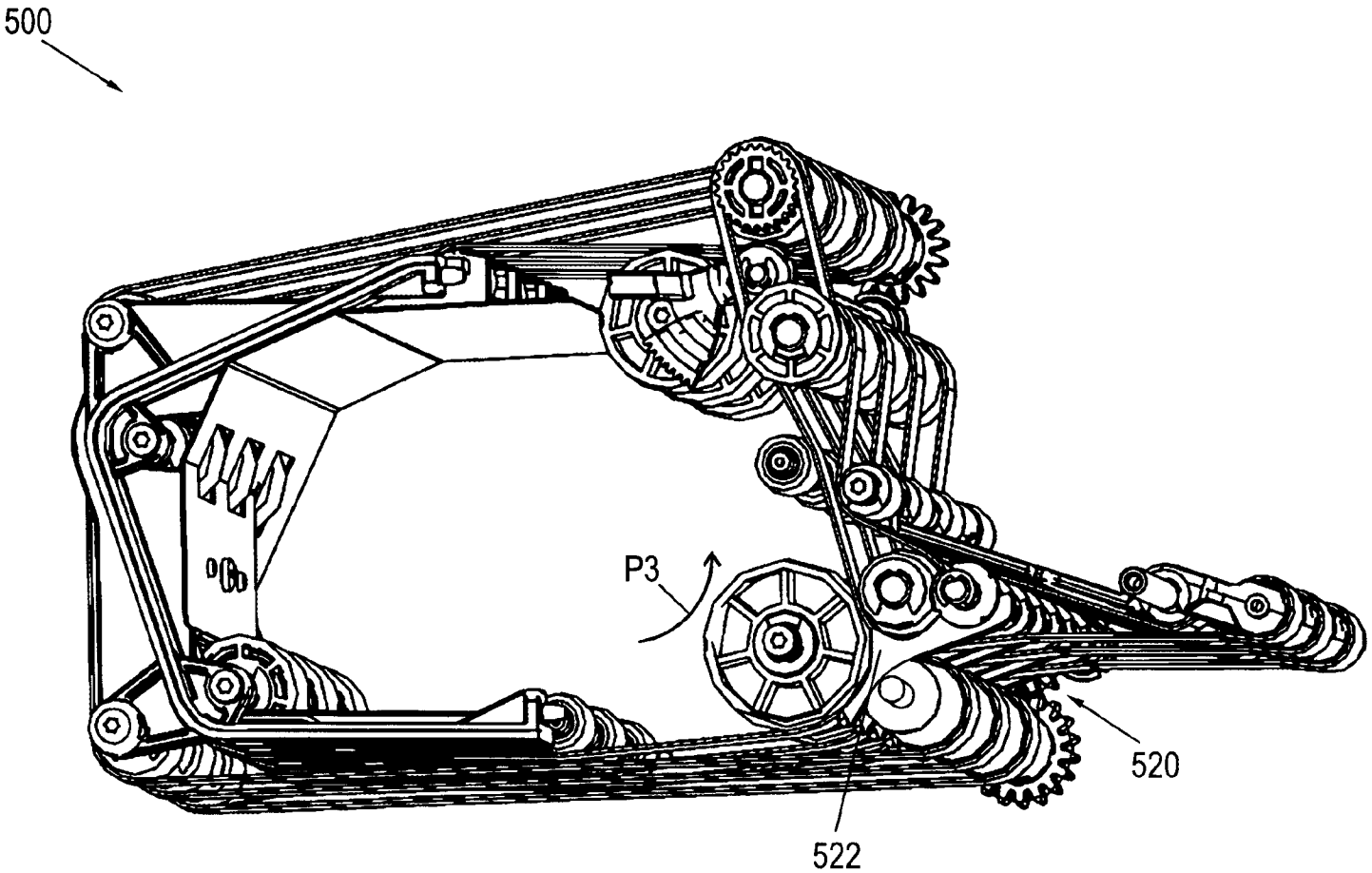
FIG. 6 shows a schematic perspective illustration of the intermediate storage according to FIGS. 4 and 5 in an operational state of intermediate storage.

Further, the second intermediate storage 500 comprises a sorting gate 520 which, in an intermediate-storage sorting-gate position, directs the sheet-shaped media intermediately stored in the second intermediate storage 500 such that they are transported within the intermediate storage 500 in a manner circulating in running direction P3, as shown in FIG. 6. The sorting gate 520 comprises a plurality of sorting gate fingers 522 which are pivotable about an axis of rotation. In the sorting-gate intermediate-storage position, these fingers do not reach into the transport path of the second intermediate storage 500 so that the sheet-shaped media intermediately stored are not directed out of the second intermediate storage 500.

Figure 7:
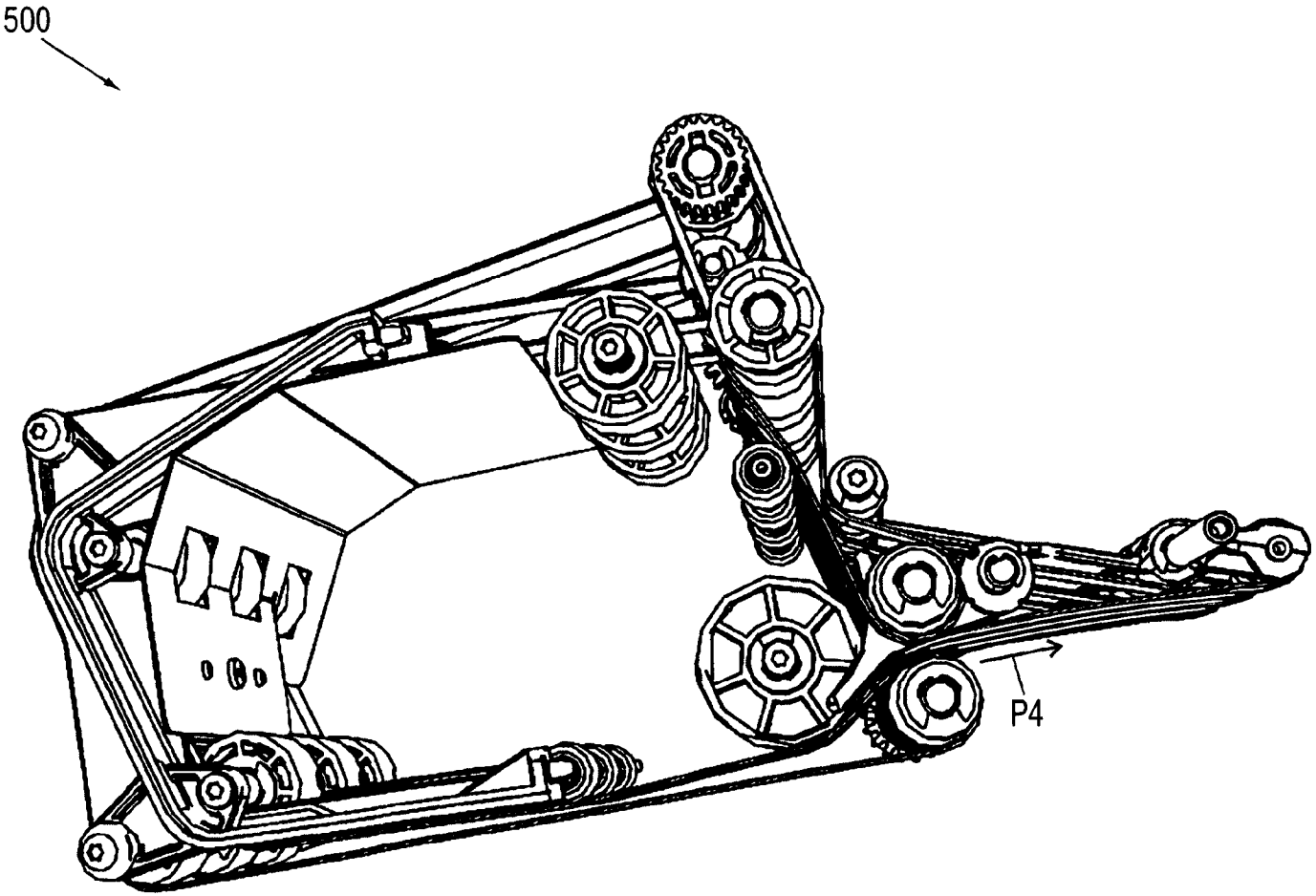
FIG. 7 shows a schematic perspective illustration of the intermediate storage according to FIGS. 4 and 5 in an operational state of removal.

In the sorting-gate removal-position shown in FIG. 7, the sorting gate fingers 522 of the sorting gate 502 are pivoted such that they reach into the transport path of the second intermediate storage 500, thus directing the sheet-shaped media intermediately stored in the second intermediate storage 500 out of the second intermediate storage 500, as indicated by arrow P4, and supplying them to the stack combining unit 802.

Shifting the sorting gate 520 between the sorting-gate intermediate-storage position and the sorting-gate removal position is preferably realized by means of a not shown solenoid or a not shown stepper motor.

Subsequently, the sheet-shaped media removed are returned to the user via the input and output unit 20. This can be effected together with the sheet-shape media intermediately stored in the first intermediate storage 32 or separately, depending on whether the confirmation information described above in connection with FIGS. 1 and 2 was input by a user.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for handling sheet-shaped media, in particular notes of value, comprising:

a transport unit for transport of the sheet-shaped media, a sensor unit for detection of at least one feature of a respective sheet-shaped medium, a control unit which classifies the sheet-shaped media in accepted sheet-shaped media and sheet-shaped media to be returned, dependent on the feature determined by the sensor unit, a sorting gate arranged downstream from the sensor unit that is connected with the sensor unit via a first transport path, wherein the control unit controls the sorting gate such that the sorting gate supplies a sheet-shaped medium classified as an accepted sheet-shaped medium to a first intermediate storage for intermediate storage of sheet-shaped media classified as accepted sheet-shaped media, and that the sorting gate supplies a sheet-shaped medium classified as a sheet-shaped medium to be returned to a second intermediate storage for intermediate storage of sheet-shaped media classified as sheet-shaped media to be returned; and wherein the sorting gate supplies the sheet-shared media classified as sheet-shared media to be returned to the second intermediate storage at a first position of the second intermediate storage, and that a further sorting gate is provided which, in a sorting-gate removal-position removes the sheet-shaped media received in the second intermediate storage from the second intermediate storage at a second position of the second intermediate storage different from the first position.

2. The device according to claim 1, wherein the sorting gate is connected with the first intermediate storage via a second transport path, and with the second intermediate storage via a third transport path, and that the control unit controls the sorting gate such that it directs a sheet-shaped medium classified as accepted sheet-shaped medium from the first transport path into the second transport path, and that the sorting gate directs a sheet-shaped medium classified as a sheet-shaped medium to be returned from the first transport path into the third transport path.

3. The device according to claim 2, wherein the third transport path is shorter than the second transport path.

4. The device according to claim 3, wherein the length of the second transport path is between 10 times and 100 times, in particular 50 times and 80 times the length of the third transport path.

5. The device according to claim 1, wherein the second intermediate storage is arranged directly following the sorting gate.

6. The device according to claim 1, wherein the sorting gate is arranged directly following the sensor unit.

7. The device according to claim 1, wherein the second intermediate storage has at least one running belt guided across transport elements, and a plurality of rollers and/or guiding elements, wherein the sheet-shaped media classified as sheet-shaped media to be returned are received in the second intermediate storage between the belts and the rollers and/or the guiding elements and are transported together with the belt in running direction.

8. The device according to claim 1, wherein the second intermediate storage has at least one belt pair comprising two running belts guided across transport elements, wherein the sheet-shaped media classified as sheet-shaped media to be returned are held in the second intermediate storage between the two belts and are transported in a running direction together with the belts.

9. The device according to claim 8, wherein the sheet-shaped media are received in the second intermediate storage such that every two sheet-shaped media consecutively received in running direction at least partly overlap each other.

10. The device according to claim 9, wherein the sheet-shaped media are received as a stack in the second intermediate storage.

11. The device according to claim 1, wherein in the second intermediate storage, maximally between 3 and 10, sheet-shaped media can be received at the same time.

12. The device according to claim 1, wherein an output unit is provided for output of the sheet-shaped media removed from the second intermediate storage as a stack to a person using the device.

13. The device according to claim 1, wherein an input unit for input of a stack of sheet-shaped media and a separation unit for separating the sheet-shaped media of the stack are provided, and that the transport unit transports the separated sheet-shaped media from the separation unit to the sensor unit.

14. The device according to claim 13, wherein after all sheet-shaped media have been received in the first intermediate storage and in the second intermediate storage dependent on their classification, a display unit displays information on the sheet-shaped media intermediately stored in the first intermediate storage to the user, and that the control unit, dependent on an information input by the user via an input unit, controls the device such that either both the sheet-shaped media intermediately stored in the first intermediate storage and the sheet-shaped media intermediately stored in the second intermediate storage are returned to the user, or only the sheet-shaped media intermediately stored in the second intermediate storage are returned to the user and the sheet-shaped media intermediately stored in the first intermediate storage are transported to at least one money cassette.

15. The device according to claim 1, wherein the control unit classified banknotes of a preset currency and checks as accepted sheet-shaped media, and that the control unit classifies all other sheet-shaped media as sheet-shaped media to be returned.

16. A device for handling sheet-shaped media, in particular notes of value, comprising:

a transport unit for transport of the sheet-shaped media, a sensor unit for detection of at least one feature of a respective sheet-shaped medium, a control unit which classifies the sheet-shaped media in accepted sheet-shaped media and sheet-shaped media to be returned, dependent on the feature determined by the sensor unit, a sorting gate arranged downstream the sensor unit that is connected with the sensor unit via a first transport path, wherein the control unit controls the sorting gate such that the sorting gate supplies a sheet-shaped medium classified as an accepted sheet-shaped medium to a first intermediate storage for intermediate storage of sheet-shaped media classified as accepted sheet-shaped media, and that the sorting gate supplies a sheet-shaped medium classified as a sheet-shaped medium to be returned to a second intermediate storage for intermediate storage of sheet-shaped media classified as sheet-shaped media to be returned, and wherein the control unit classified banknotes of a preset currency and checks as accepted sheet-shaped media, and that the control unit classifies all other sheet-shaped media as sheet-shaped media to be returned.

* * * * *